US009650219B2

(12) United States Patent
Yoshiura et al.

(10) Patent No.: US 9,650,219 B2
(45) Date of Patent: May 16, 2017

(54) PAPER CONVEYING DEVICE AND IMAGE FORMING DEVICE

(71) Applicants: Arinobu Yoshiura, Kanagawa (JP); Hideo Nagafuji, Kanagawa (JP); Yuji Arai, Kanagawa (JP); Kohichi Utsunomiya, Kanagawa (JP); Kiho Sai, Tokyo (JP); Shohei Saito, Kanagawa (JP); Yutaka Ikebuchi, Kanagawa (JP); Motoyoshi Yamano, Kanagawa (JP)

(72) Inventors: Arinobu Yoshiura, Kanagawa (JP); Hideo Nagafuji, Kanagawa (JP); Yuji Arai, Kanagawa (JP); Kohichi Utsunomiya, Kanagawa (JP); Kiho Sai, Tokyo (JP); Shohei Saito, Kanagawa (JP); Yutaka Ikebuchi, Kanagawa (JP); Motoyoshi Yamano, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/013,272

(22) Filed: Feb. 2, 2016

(65) Prior Publication Data

US 2016/0221775 A1 Aug. 4, 2016

(30) Foreign Application Priority Data

Feb. 3, 2015 (JP) ..... 2015-019045

(51) Int. Cl.
*B65H 5/38* (2006.01)
*B65H 29/52* (2006.01)
(Continued)

(52) U.S. Cl.
CPC ..... *B65H 5/062* (2013.01); *B65H 5/38* (2013.01); *B65H 29/52* (2013.01);
(Continued)

(58) Field of Classification Search
CPC ..... G03G 21/1633; B65H 5/38; B65H 2402/441; B65H 5/36; B65H 2402/31;
(Continued)

(56) References Cited

U.S. PATENT DOCUMENTS 9,031,462 B2 * 5/2015 Mori ..... G03G 21/1633 399/124
2011/0222926 A1 9/2011 Ueno et al.
(Continued)

FOREIGN PATENT DOCUMENTS

JP 2011-191388 9/2011
JP 4989311 5/2012
(Continued)

*Primary Examiner* — Luis A Gonzalez
(74) *Attorney, Agent, or Firm* — Oblon, McClelland, Maier & Neustadt, L.L.P.

(57) ABSTRACT

A paper conveying device includes a conveying guide, a bearing, a conveying-guide facing surface, and a separation restrictor. The conveying guide includes a conveyance surface for conveying paper and a pivot shaft and is swingable about the pivot shaft. The bearing includes a support surface facing at least an upper semiperimeter of the pivot shaft. The conveying-guide facing surface is provided to face an end of the conveying guide when the conveying guide swings. The end is opposite to the conveyance surface. The separation restrictor is provided to the conveying guide to restrict separation of the pivot shaft from the bearing at least in a given swing range of the conveying guide by contacting the conveying-guide facing surface.

12 Claims, 13 Drawing Sheets

(51) Int. Cl.
*B65H 5/06* (2006.01)
*G03G 15/00* (2006.01)
*G03G 15/20* (2006.01)

(52) U.S. Cl.
CPC ..... *G03G 15/6529* (2013.01); *B65H 2402/31* (2013.01); *B65H 2404/611* (2013.01); *B65H 2404/693* (2013.01); *B65H 2601/11* (2013.01); *G03G 15/2028* (2013.01); *G03G 15/6573* (2013.01); *G03G 2215/00675* (2013.01); *G03G 2215/00679* (2013.01)

(58) Field of Classification Search
CPC ..... B65H 2402/53; B65H 2402/531; B65H 2402/52; B65H 2404/693; B65H 2404/611
See application file for complete search history.

(56) References Cited

U.S. PATENT DOCUMENTS

2015/0239689 A1* 8/2015 Taniguchi ..... B65H 5/062 271/264
2015/0268623 A1* 9/2015 Yamamoto ..... G03G 21/1647 399/107
2015/0268626 A1 9/2015 Saito et al.

FOREIGN PATENT DOCUMENTS

JP 2013-186287 9/2013
JP 2015-071825 4/2015

* cited by examiner

PAPER CONVEYING DEVICE AND IMAGE FORMING DEVICE

CROSS-REFERENCE TO RELATED APPLICATIONS

The present application claims priority to and incorporates by reference the entire contents of Japanese Patent Application No. 2015-019045 filed in Japan on Feb. 3, 2015.

BACKGROUND OF THE INVENTION

1. Field of the Invention

The present invention relates to a paper conveying device and an image forming device.

2. Description of the Related Art

Examples of image forming devices employing an electrophotography method include a copying device, a facsimile device, a printer, and a printing device. Such an image forming device fixes, on paper, a fixing target image transferred onto and held on the paper as a recording medium, and then outputs the image. The image forming device includes a plurality of conveying paths for conveying paper, one of which is a conveying path for conveying paper having passed through a fixing device to an ejecting unit. When a conveyance failure such as a paper jam occurs on the paper passing through the conveying path, this paper needs to be removed from the conveying path. A known configuration to facilitate this removal allows one of conveying guides disposed facing each other across the conveying path to be swung away from the conveying path so as to open the conveying path (refer to Japanese Patent Laid-open No. 2013-186287, for example).

For a cost reduction in mold manufacturing, a known configuration includes a bearing part molded separately in an upper-periphery receiving part and a lower-periphery receiving part that are used for supporting a pivot shaft of a conveying guide. With this configuration, however, the upper-periphery receiving part and the lower-periphery receiving part of the bearing part are shifted from each other in the axial direction of the pivot shaft. Thus, when an axial end of the pivot shaft is moved to a position off the lower-periphery receiving part, the pivot shaft is not supported, and the conveying guide potentially falls off. To prevent this fall, another known configuration includes a separation restrictor that restricts the separation of the pivot shaft from the bearing part by contacting the conveying guide from underneath at a position different from a position at which the pivot shaft is supported by the bearing part. In this configuration, the separation restrictor is provided underneath the conveying guide, and contacts the conveying guide when the axial end of the pivot shaft of the conveying guide is shifted from the lower-periphery receiving part of the bearing part, thereby preventing the conveying guide from falling.

The configuration including the separation restrictor described above is effective as long as the conveying guide moves by an angle in the range of an acute angle. When the conveying guide moves by an angle beyond an obtuse angle, however, the separation restrictor and the conveying guide do not contact each other, and the conveying guide falls.

Therefore, there is a need for a paper conveying device capable of preventing a fall of the conveying guide due to a fall of the pivot shaft of the conveying guide off the bearing part.

SUMMARY OF THE INVENTION

It is an object of the present invention to at least partially solve the problems in the conventional technology.

According to an embodiment, a paper conveying device includes a conveying guide, a bearing, a conveying-guide facing surface, and a separation restrictor. The conveying guide includes a conveyance surface for conveying paper and a pivot shaft and is swingable about the pivot shaft. The bearing includes a support surface facing at least an upper semiperimeter of the pivot shaft. The conveying-guide facing surface is provided to face an end of the conveying guide when the conveying guide swings. The end is opposite to the conveyance surface. The separation restrictor is provided to the conveying guide to restrict separation of the pivot shaft from the bearing at least in a given swing range of the conveying guide by contacting the conveying-guide facing surface.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an exemplary embodiment of the present invention will be described with reference to the accompanying drawings. An image forming device 100 that includes an exemplary paper conveying device according to the embodiment of the present invention and a fixing device including this paper conveying device assumes a printer. However, the present invention is not limited thereto, and is also applicable to a copier, a facsimile, and a multifunction peripheral having their functionalities.

Figure 1:
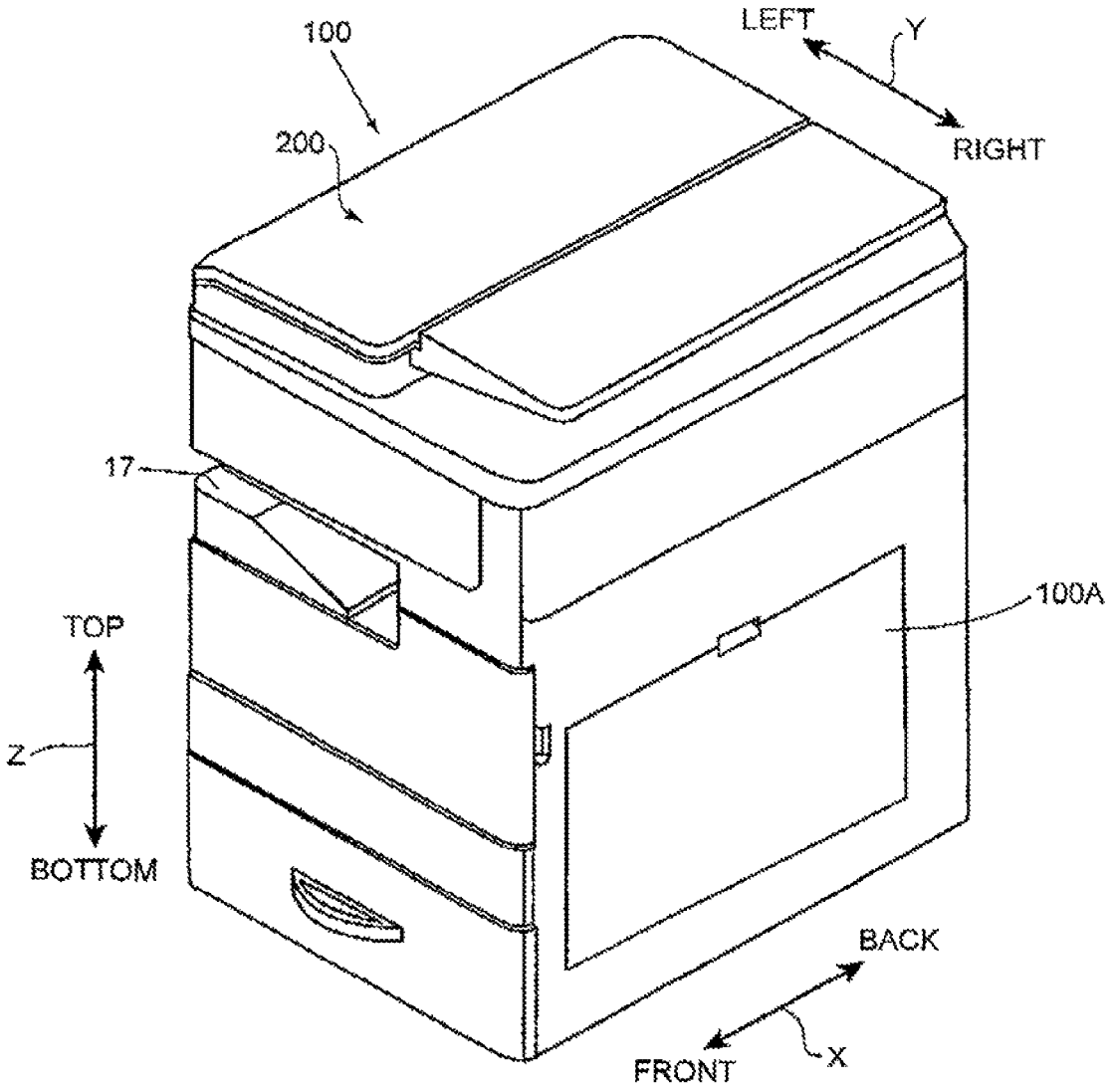
FIG. 1 is an exterior diagram of an image forming device according to an embodiment of the present invention.

In FIG. 1, the image forming device 100 has a body that is a rectangular parallelepiped housing having dimensions in a first direction, a second direction, and a third direction, the first direction being the front-back direction (X direction indicated by arrow X), the second direction being the right-left direction (Y direction indicated by arrow Y) orthogonal to the first direction, the third direction being the vertical direction (Z direction indicated by arrow Z). The direction indicated by arrow X is parallel to the width direction of the image forming device 100 and the longitudinal direction (axial direction) of a fixing member and a facing rotation body included in a fixing device 20 to be described later, and correspond to the width direction of paper as a recording medium.

The image forming device 100 includes a document scanning device 200 mounted above an image forming unit in the Z direction, and a paper ejection tray 17 serving as a recessed paper ejection unit in a front part of the image forming device 100 and below the document scanning device 200. In FIG. 1, an external cover 100A as an openable member is provided on one side of the image forming device 100 in the Y direction as the right-left direction. When the external cover 100A is open, the fixing device 20 illustrated in FIG. 2 is externally viewable.

Figure 2:
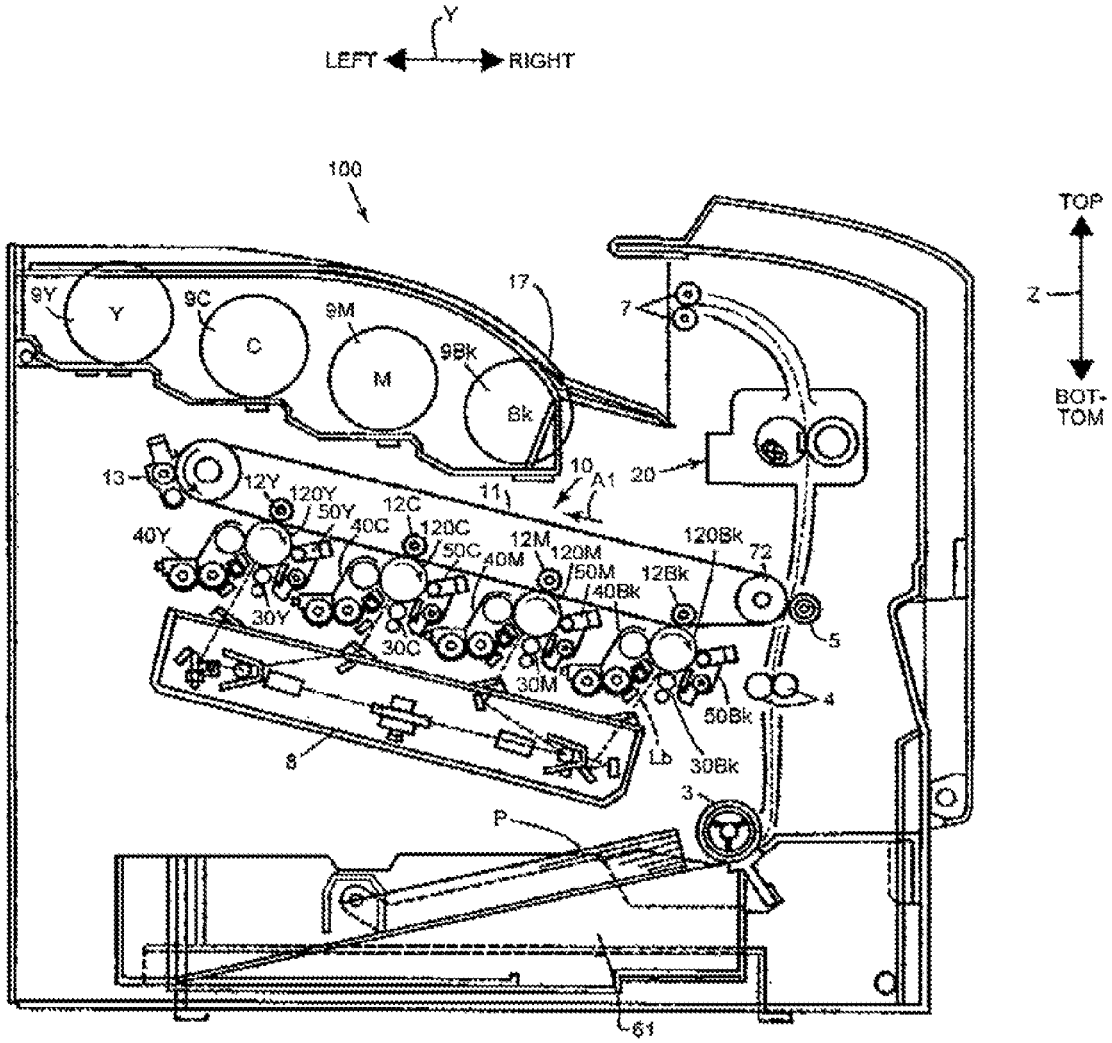
FIG. 2 is a schematic diagram of the image forming device according to the embodiment of the present invention.

In the image forming device 100, components illustrated in FIG. 2 are disposed. The following describes the configuration and effect of the image forming device 100. The document scanning device 200 illustrated in FIG. 1 is omitted in FIG. 2. In FIG. 2, in the image forming device 100, visible images are formed through photoconductor drums 120Y, 120C, 120M, and 120Bk by a well-known electrophotographic copying process and sequentially transferred onto a transfer belt 11 moving in the direction of arrow A1. This transferring process serves as a primary transferring process, in which the images are sequentially transferred onto the transfer belt 11 to form superimposed images. These superimposed images held on the transfer belt 11 are collectively transferred onto paper P such as a recording sheet.

Various devices are disposed around each of the photoconductor drums 120Y, 120C, 120M, and 120Bk to perform image formation when the photoconductor drum rotates. Description will be made of these devices for the photoconductor drum 120Bk that forms a black image, as an example. A charging device 30Bk, a developing device 40Bk, a primary transfer roller 12Bk, and a cleaning device 50Bk are disposed around the photoconductor drum 120Bk to perform the image formation along the rotational direction. Writing to be performed after charging is performed by a light scanning device 8 to be described later.

A superimposition transfer onto the transfer belt 11 is sequentially performed through transfer-bias application using primary transfer rollers 12Y, 12C, 12M, and 12Bk arranged facing the respective photoconductor drums 120Y, 120C, 120M, and 120Bk across the transfer belt 11. The respective photoconductor drums 120Y, 120C, 120M, and 120Bk are accommodated in process cartridges (not illustrated) arranged in order from the upstream in the direction of arrow A1. The photoconductor drums 120Y, 120C, 120M, and 120Bk are included in image stations for forming images of yellow, cyan, magenta, and black, respectively.

The primary transferring process is executed by a transfer belt unit 10 including the transfer belt 11 and the primary transfer rollers 12Y, 12C, 12M, and 12Bk arranged facing the photoconductor drums 120Y, 120C, 120M, and 120Bk across the transfer belt 11. Images superimposed on the transfer belt 11 are collectively transferred through the secondary transferring process performed on the paper P by a secondary-transfer roller 5 that rotates as the transfer belt 11 rotates.

The image forming device 100 includes, in addition to the process cartridges and the transfer belt unit 10 described above, the light scanning device 8 as an optical writing device arranged facing the four image stations from underneath, and a cleaning device 13 of the transfer belt 11.

The light scanning device 8 includes a semiconductor laser as a light source, a coupling lens, an fθ lens, a toroidal lens, a mirror, a rotary polygon mirror, and other components. The light scanning device 8 emits writing light Lb (in FIG. 2, a reference sign is added only to light through the image station for a black image as an example for simplicity, but should be understood to refer to the other image stations as well) corresponding to the respective colors to the photoconductor drums 120Y, 120C, 120M, and 120Bk. This forms electrostatic latent images on the respective photoconductor drums 120Y, 120C, 120M, and 120Bk.

The image forming device 100 includes a sheet feeding device 61 that feeds the paper P onto which the images are to be collectively transferred through the secondary transferring process, and a registration roller pair 4 that sets a registration timing of the paper P fed out from the sheet feeding device 61 and then feeds the paper P to a position for the secondary transferring process. The image forming device 100 also includes a sensor (not illustrated) that detects arrival of the head of the paper P at the registration roller pair 4.

The paper P onto which toner images T on the transfer belt 11 have been collectively transferred through the secondary transferring process is conveyed to the fixing device 20 (described later), whereby the toner images are fixed on the paper P. The paper P after the fixation is ejected through a paper ejection roller 7 to the paper ejection tray 17 provided outside of the image forming device 100. In FIG. 2, reference signs 9Y, 9C, 9M, and 9Bk denote tanks for supplying toner to the respective developing devices included in the image stations.

Figure 3:
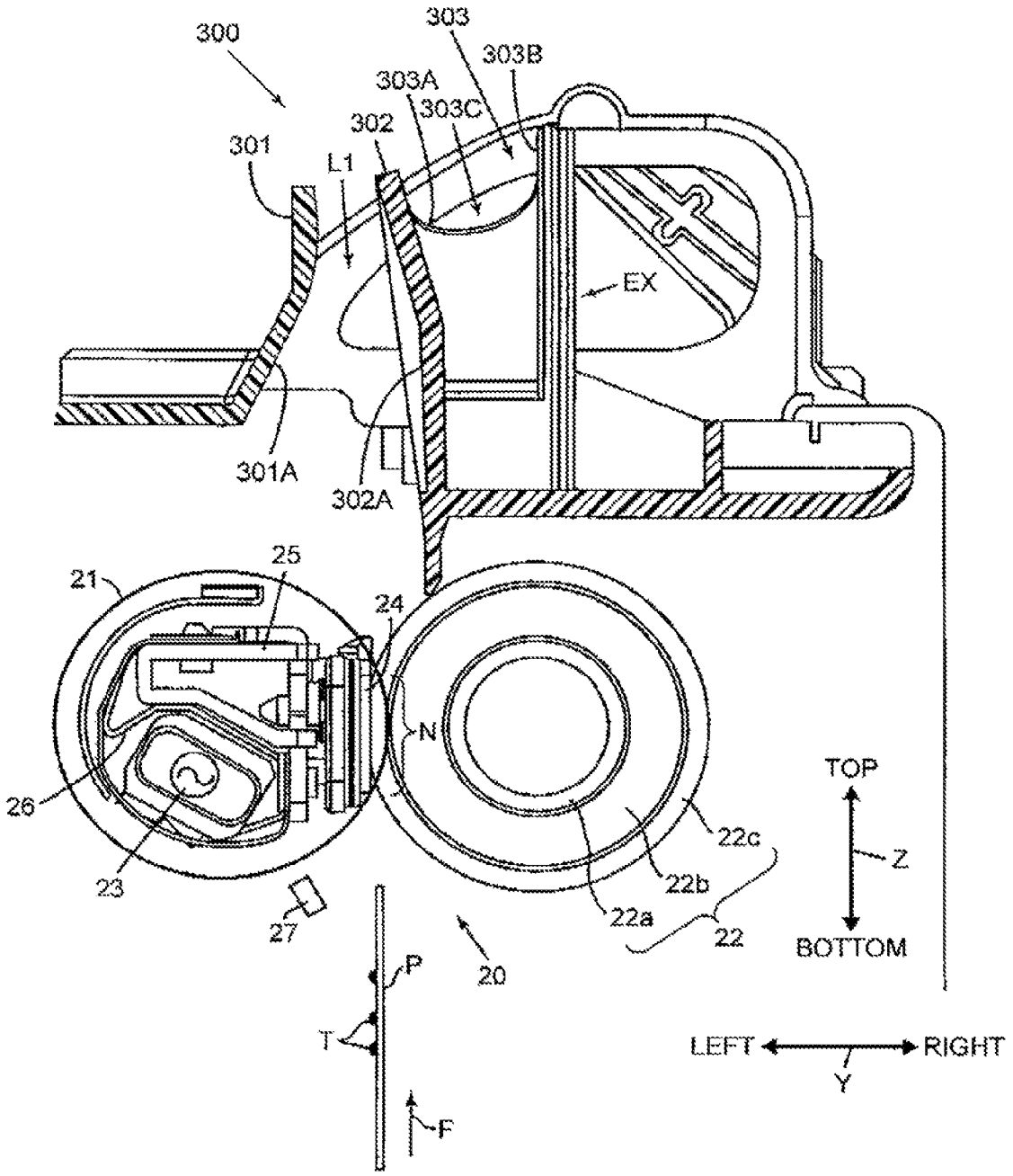
FIG. 3 is a schematic diagram of a paper conveying device and a fixing device according to the embodiment of the present invention.

As illustrated in FIG. 3, the fixing device 20 includes a flexible fixing belt 21 that is used for fixing the transferred toner images T held on the paper P through melting and permeation with heat and pressure and is rotatable while being heated. The fixing device 20 includes, in addition to the fixing belt 21, a pressing roller 22 as a facing rotation body that applies pressure to the fixing belt 21 while being in contact therewith so as to jointly serve as a nipping part N. Provided inside the fixing belt 21 is a heater 23 that includes a halogen lamp as a heat source and heats a part other than the nipping part N, which is a region of the fixing belt 21, rotating on a side opposite to the nipping part N in this embodiment.

Figure 4:
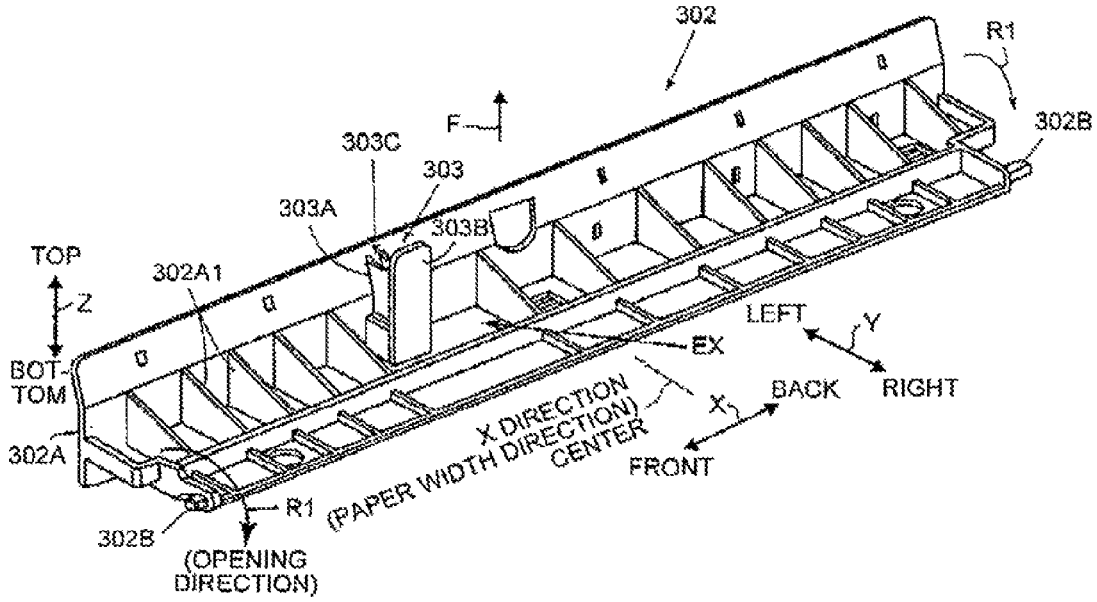
FIG. 4 is a schematic diagram of a conveying guide used in the embodiment of the present invention.

Provided inside the fixing belt 21 are also a nip forming member 24 as a base member for forming the nipping part, which is arranged on the inner surface of the fixing belt 21, a stay 25 supporting the nip forming member 24, and a reflecting member 26 that reflects light emitted from the heater 23 onto the fixing belt 21. The nip forming member 24 as the base member for forming the nipping part includes a slide sheet (low-friction sheet), around which a base pad is wound, as a member that contacts the fixing belt 21. The nipping part N of the nip forming member 24 is flat, but not limited to this shape. For example, when the nipping part N is formed to be concave along the periphery of the pressing roller 22, the head of the paper P passing through the nipping part N is closer to the pressing roller 22, which advantageously improves its separability from the fixing belt 21. Temperature of the fixing belt 21 is detected by a temperature sensor 27 provided on a side from which the paper P goes into the nipping part, and is used for feedback processing of the heater 23. In FIGS. 3 and 4, arrow F indicates the direction of conveying the paper P.

The fixing belt 21 is a thin, flexible endless belt formed as a sleeve, and includes a base material and a releasing layer positioned on a surface of the base material. The base material is made of metal material such as nickel or stainless steel, or resin material such as polyimide. The releasing layer is made of, for example, tetrafluoroethylene-perfluoroalkyl vinyl ether copolymer (PFA) or polytetrafluoroethylene (PTFE), which have releasability from toner.

The pressing roller 22 includes a cored bar 22*a*, an elastic layer 22*b* provided on a surface of the cored bar 22*a*, and a releasing layer 22*c* provided on a surface of the elastic layer 22*b*. The elastic layer 22*b* is made of, for example, foamable silicone rubber, silicone rubber, or fluoro-containing rubber. The releasing layer 22*c* is made of, for example, PFA or PTFE. The pressing roller 22 is pressed toward the fixing belt 21 by a pressing unit (not illustrated) to be in contact with the fixing belt 21 and the nip forming member 24 as the base meaner via the fixing belt 21. The elastic layer 22*b* of the pressing roller 22 is squashed where the pressing roller 22 and the fixing belt 21 contact each other, receiving pressure therebetween to cause the nip forming member 24 to form the nipping part N having a predetermined width.

The pressing roller 22 is rotated by a driving source (not illustrated) such as a motor provided to a printer body. Driving power of the rotation of the pressing roller 22 is transferred to the fixing belt 21 at the nipping part N, and the fixing belt 21 is rotated accordingly. The pressing roller 22, which is a solid-core roller in the configuration illustrated in FIG. 3, may be a hollow roller. With the hollow roller, a heating source such as a halogen heater utilizing radiation heat may be arranged inside the pressing roller 22.

A configuration without the elastic layer 22*b* reduces thermal capacity and has an improved fixability, however, minute unevenness on the surface of the fixing belt can be transferred onto an image when toner is squashed to be fixed, generating uneven brightness on a solid color part of the image. This may be prevented by desirably providing an elastic layer having a thickness of 100 μm or larger. A pipe-shaped metal used for the hollow roller can be selected from aluminum, iron, stainless steel, and the like. With a configuration in which a heat source is provided inside the pressing roller 22, it is desirable to provide a heat-insulating layer on a surface of a support or to provide a mirror-finished heat-reflecting surface thereon, so as to prevent the support from being heated by the radiation heat from the heat source. The heat source in this case is not limited to the halogen heater described above, and may be an IH heater, a resistance heating element, or a carbon heater.

The image forming device 100, which includes the fixing device 20 having the configuration described above, is provided with a paper conveying device 300 for conveying the paper P. As illustrated in FIG. 3, the paper conveying device 300 conveys, as a conveyance target, the paper P passing through the nipping part N of the fixing device 20, for example. As illustrated in FIG. 3, the paper conveying device 300 provides a conveying path continuous from an exit of the fixing device 20 to convey the paper P having passed through the nipping part N to the paper ejection tray 17 (refer to FIG. 2).

As illustrated in FIG. 3, the paper conveying device 300 includes a pair of conveying guides 301 and 302 having conveyance surfaces 301A and 302A for conveying the paper P. The conveying guides 301 and 302 constitute a conveying path L1 and are used also as conveying members serving as guides on the exit side of the fixing device 20. The conveying guide 301 is fixed, whereas the conveying guide 302 is swingable about, as a base end, an end thereof provided with pivot shafts denoted by reference sign 302B in FIG. 4 as swing pivots. Hereinafter, the conveying guide 302 is referred to as the swingable conveying guide 302.

The conveying guides 301 and 302 are disposed on the exit side of the fixing device 20, and thus are made of a material that is unlikely to cause, for example, deformation due to heat. Examples of such a material include a resin material including glass fiber. Consequently, the swingable conveying guide 302 is unlikely to suffer from heat deformation. Each pivot shaft 302B used as the swing pivot has its head periphery cut in a C-shape (C-cut) or a round shape (R-cut) to facilitate its insertion into a bearing part 400 (refer to FIG. 5). Note that arrows X, Y, end Z in the following description are the same as arrows X, Y, and Z illustrated in FIG. 1, respectively. In particular, arrow X among the arrows corresponds to the width direction of paper parallel to the axial direction of the pressing roller 22 used as the facing rotation body.

The swingable conveying guide 302 has the conveyance surface 302A extending in the X direction as the first direction in the image forming device 100 and conveys the paper P as illustrated in FIG. 4. The swingable conveying guide 302 guides the paper P in the paper conveying direction indicated by arrow F. In FIG. 4, reference sign EX denotes a surface to be exposed when the external cover 100A (refer to FIG. 1) of the image forming device 100 is opened. This surface EX is positioned downstream in an opening direction indicated by arrow R1 and behind the conveyance surface 302A.

Figure 6A:
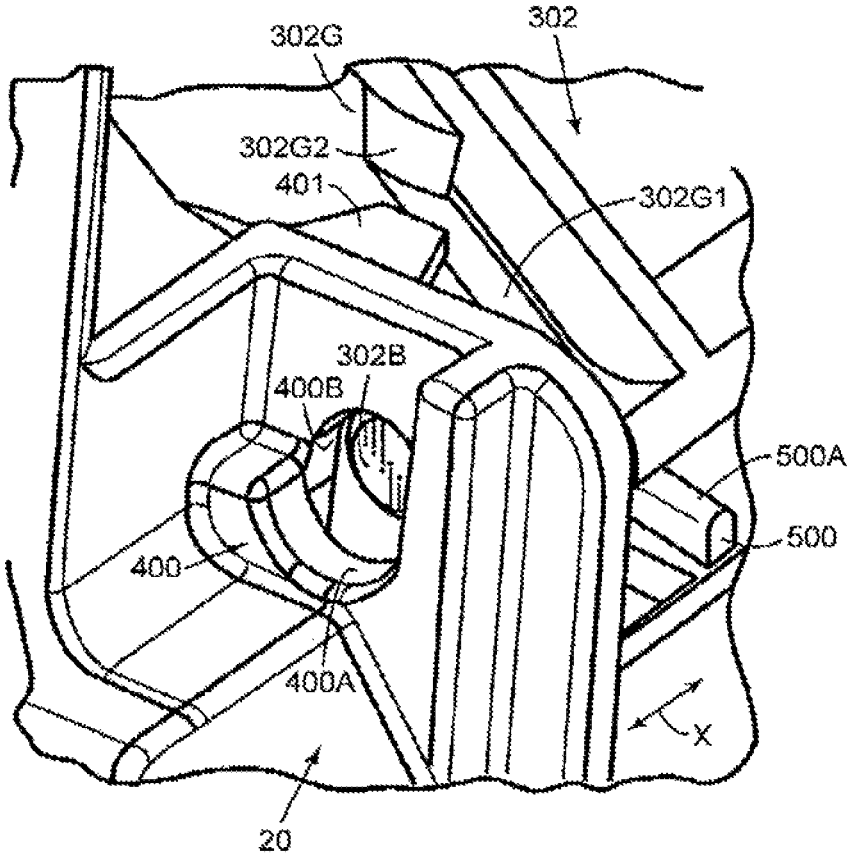
FIGS. 6A, 6B, and 6C are schematic diagrams of a bearing part of the conveying guide used in the embodiment of the present invention.
Figure 6B:
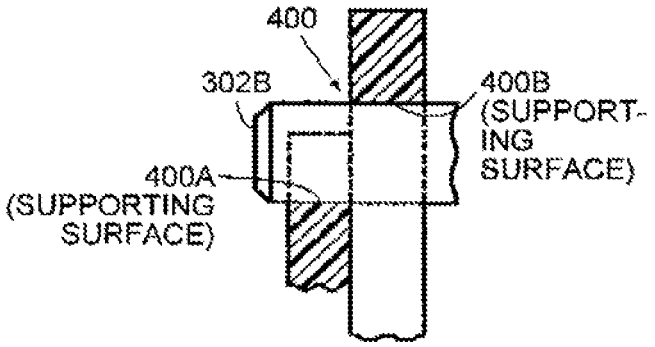

In FIG. 4, the swingable conveying guide 302 is provided with the pivot shafts 302B each serving as the pivot of swing about the X direction when the external cover 100A of the image forming device 100 is opened. The pivot shafts 302B as the swing pivots are provided in a pair respectively on both sides of the swingable conveying guide 302 in the width direction thereof in the X direction, protruding toward outsides from the sides in the X direction. As illustrated in FIG. 6B, the protrusion of each pivot shaft 302B has a length that enables its insertion to a supporting surface 400A of the bearing part 400, from the edge of the corresponding side of the swingable conveying guide 302 in the width direction.

The swingable conveying guide 302 swings about the pivot shaft 302B as the swing pivot in the direction of arrow R1 illustrated in FIG. 4, as described below. Specifically, the swingable conveying guide 302 can swing between a first position and a second position. The first position is a facing position at which the swingable conveying guide 302 faces the conveying path of the paper P, in other words, at which the swingable conveying guide 302 forms the conveying path that is the state illustrated in FIG. 9A. The second position is a swing position at which the swingable conveying guide 302 is retracted away from the conveying path that is the state illustrated in FIG. 9C. A swing toward the second position opens the conveying path, allowing removal of the paper P causing a conveyance failure such as a paper jam in the conveying path. The swing from the first position to the second position is performed by using a handle part 303 provided to the exposed surface EX illustrated in FIGS. 3 and 4.

As illustrated in FIG. 4, the handle part 303 includes a rib 303A extending from the back surface of the conveyance surface 302A at a position little closer to the front side of a central part in the X direction, and a finger hook 303B integrated with the head of the rib 303A in its extending direction. For example, after the external cover 100A illustrated in FIG. 1 is opened, a hand inserted from the front side in the X direction is allowed to swiftly reach the position of the handle part 303 to operate it because the handle part 303 is positioned little closer to the front side of a central part in the X direction. The handle part 303 provides a space 303C between the rib 303A and the finger hook 303B, for allowing insertion of a finger as illustrated in FIGS. 3 and 4, which facilitates an operation to swing the swingable conveying guide 302 in the opening direction.

Figure 5:
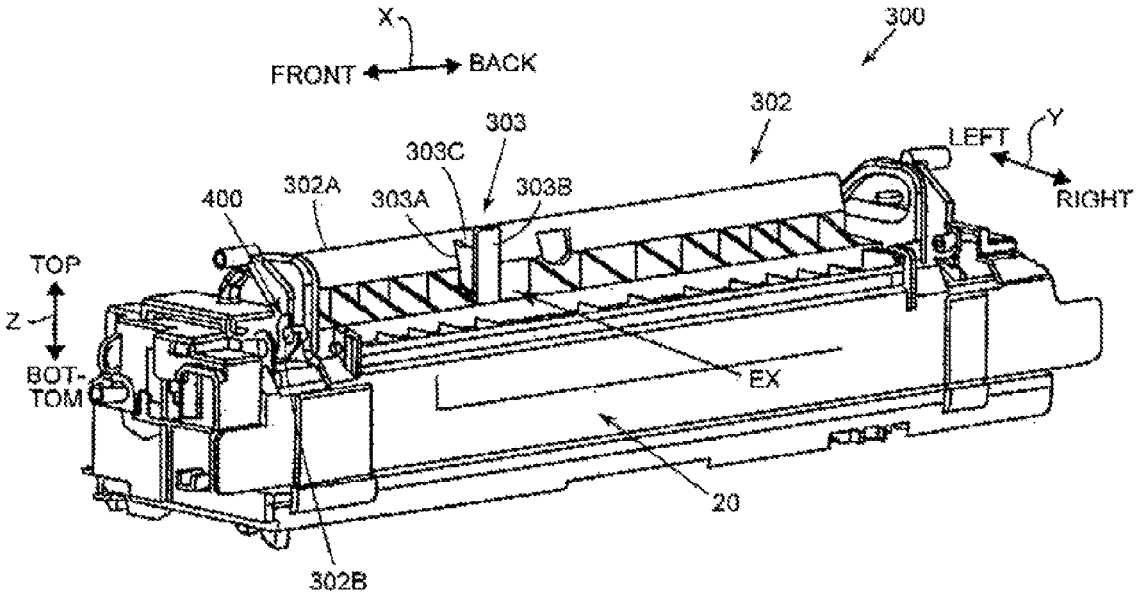
FIG. 5 is a schematic diagram of the paper conveying device and the fixing device used in the embodiment of the present invention.
Figure 6C:
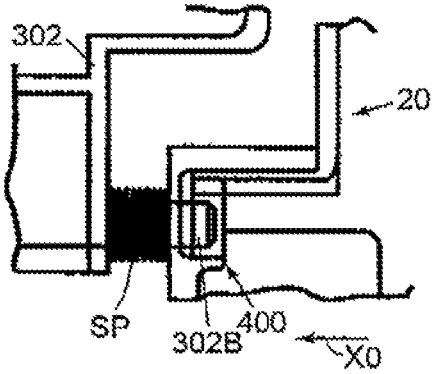

As illustrated in FIG. 5, the swingable conveying guide 302 is swingable in the direction of arrow R1. An end of each pivot shaft 302B in an axial direction thereof is inserted in and supported by a bearing part 400 provided on a housing of the fixing device 20, while being movable in the axial direction. The bearing parts 400 are formed in pair as resin-formed portions integrated in part of the housing of the fixing device 20 so as to support the pair of the pivot shafts 302B at the ends thereof in the axial direction. The supporting surface 400A that supports a lower semiperimeter of the corresponding pivot shaft 302B and a supporting surface 400B that supports an upper semiperimeter of the corresponding pivot shaft 302B are arranged side by side in the X direction as illustrated in FIGS. 6A, 6B, and 6C because of restriction on a demolding direction in resin formation. With the configuration illustrated in FIGS. 6A, 6B, and 6C, the supporting surface 400B is provided closer to a central part in the axial direction of the pivot shaft 302B, whereas the supporting surface 400A is adjacently provided outside the supporting surface 400B. This configuration applies to both of the bearing parts 400.

When it is difficult to form, on the housing of the fixing device 20, a single bearing that supports the entire perimeter of the pivot shaft 302B, an increase in mold manufacturing cost can be prevented by formation with a mold that can be halved in the vertical direction as in this embodiment.

As illustrated in FIG. 6B, the supporting surface 400A of the bearing part 400 has no surface for receiving the upper semiperimeter of the pivot shaft 302B, whereas the supporting surface 400B thereof has no surface for receiving the lower semiperimeter of the pivot shaft 302B. Thus, when an axial end of the pivot shaft 302B is placed where the supporting surface 400B has no surface for receiving a lower periphery of the pivot shaft 302B, this absence of a support would result in a fall of the pivot shaft 302B.

For this reason, as illustrated in FIG. 6C, an elastic body SP as a pressing member such as spring is disposed on one of the pivot shafts 302B in the axial direction, and the pivot shafts 302B are held at positions to avoid failing off the supporting surface 400A. In such a configuration, for example, a distance between the ends of the pair of the pivot shafts 302B is set to be larger than a distance between the pair of the supporting surfaces 400A. The elastic body SP is used as a member that presses the swingable conveying guide 302 in the first direction parallel to the pivot shaft 302B, specifically, in a first direction X0 toward the front side along the X direction. The bearing part 400 illustrated in FIG. 6C is provided on a side opposite to the bearing part 400 illustrated in FIG. 6A in the axial direction of the pivot shaft 302B.

Figure 7:
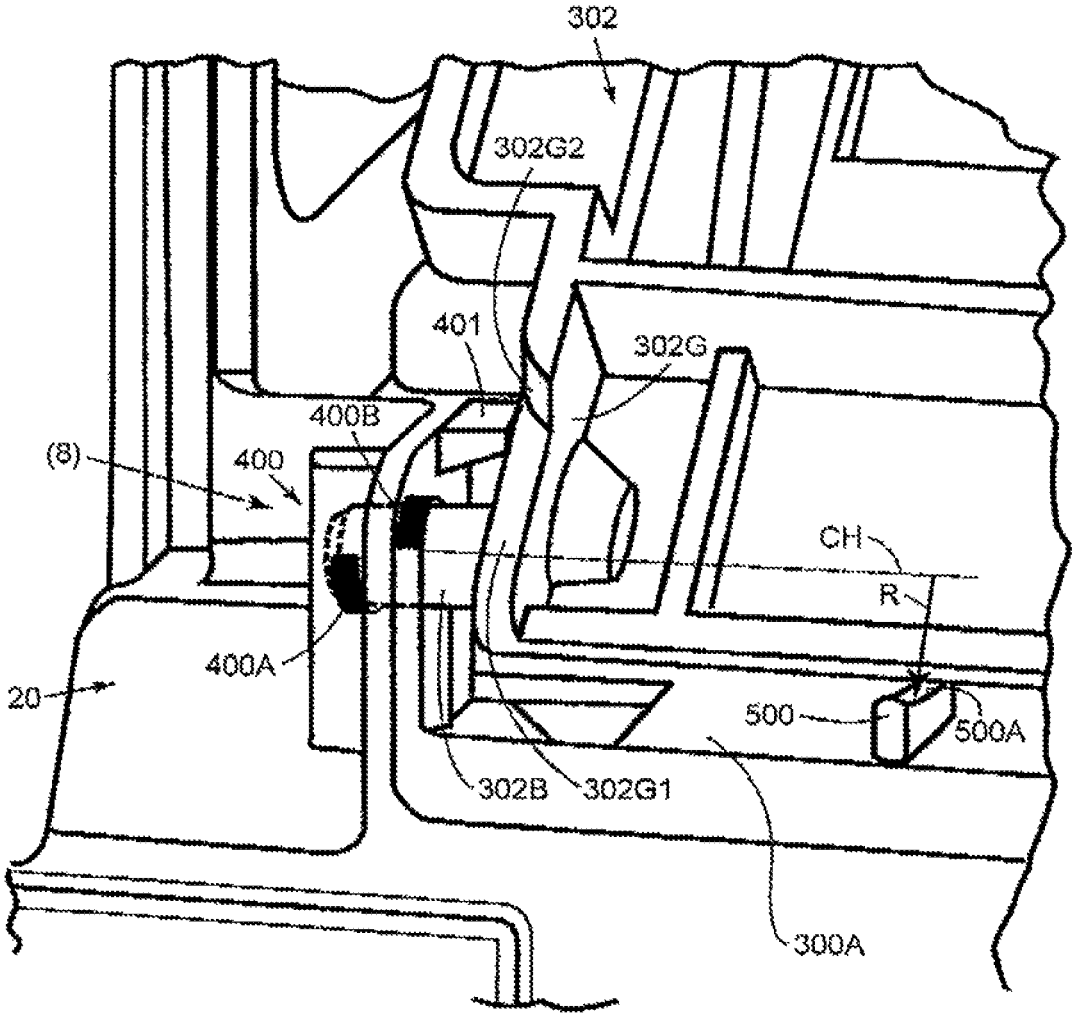
FIG. 7 is a schematic diagram of the bearing part of the conveying guide used in the embodiment of the present invention.

The fall of the axial end of the pivot shaft 302B when placed on the supporting surface 400B is desirably prevented without the use of the elastic body SP in order to avoid an increase in the number of components only for the fall prevention of the pivot shaft 302B. For this purpose, in the present embodiment, a separation restricting member 500 is provided between the ends of the pair of the pivot shafts 302B in the axial direction, facing the swingable conveying guide 302 from underneath at a position different from a position where the bearing part 400 supports the pivot shaft 302B, as illustrated in FIG. 7. The separation restricting member 500 is arranged on a conveying-guide facing surface 300A of the paper conveying device 300. The conveying-guide facing surface 300A is part of the housing of the fixing device 20 provided with the bearing part 400 and faces an end of the swingable conveying guide 302, the end being opposite to the conveyance surface 302A.

The separation restricting member 500 is a member that contacts the swingable conveying guide 302 from underneath and is used for restricting the separation of the pivot shaft 302B from the bearing part 400. The separation restricting member 500 includes a convex portion having a curved surface 500A along an arc about the pivot shaft 302B. In FIG. 7, reference sign R denotes a radius from a rotation center CH of the pivot shaft 302B to the curved surface 500A. In the present embodiment, the separation restricting member 500 is provided substantially in a central part in the width direction of the swingable conveying guide 302, specifically at a position bisecting the swingable conveying guide 302 in the X direction. However, the separation restricting members 500 may be provided at a plurality of positions having equal intervals in the axial direction of the pivot shaft 302B so that the separation restricting members 500 equally divide the swingable conveying guide 302 in the X direction. This configuration in which the separation restricting members 500 equally divide the swingable conveying guide 302 at a plurality of positions in the X direction can equally distribute to reduce a concentrated load received by the swingable conveying guide 302 when the separation restricting members 500 contacts the swingable conveying guide 302. This can prevent or reduce deformation and damage of the swingable conveying guide 302.

Figure 8:
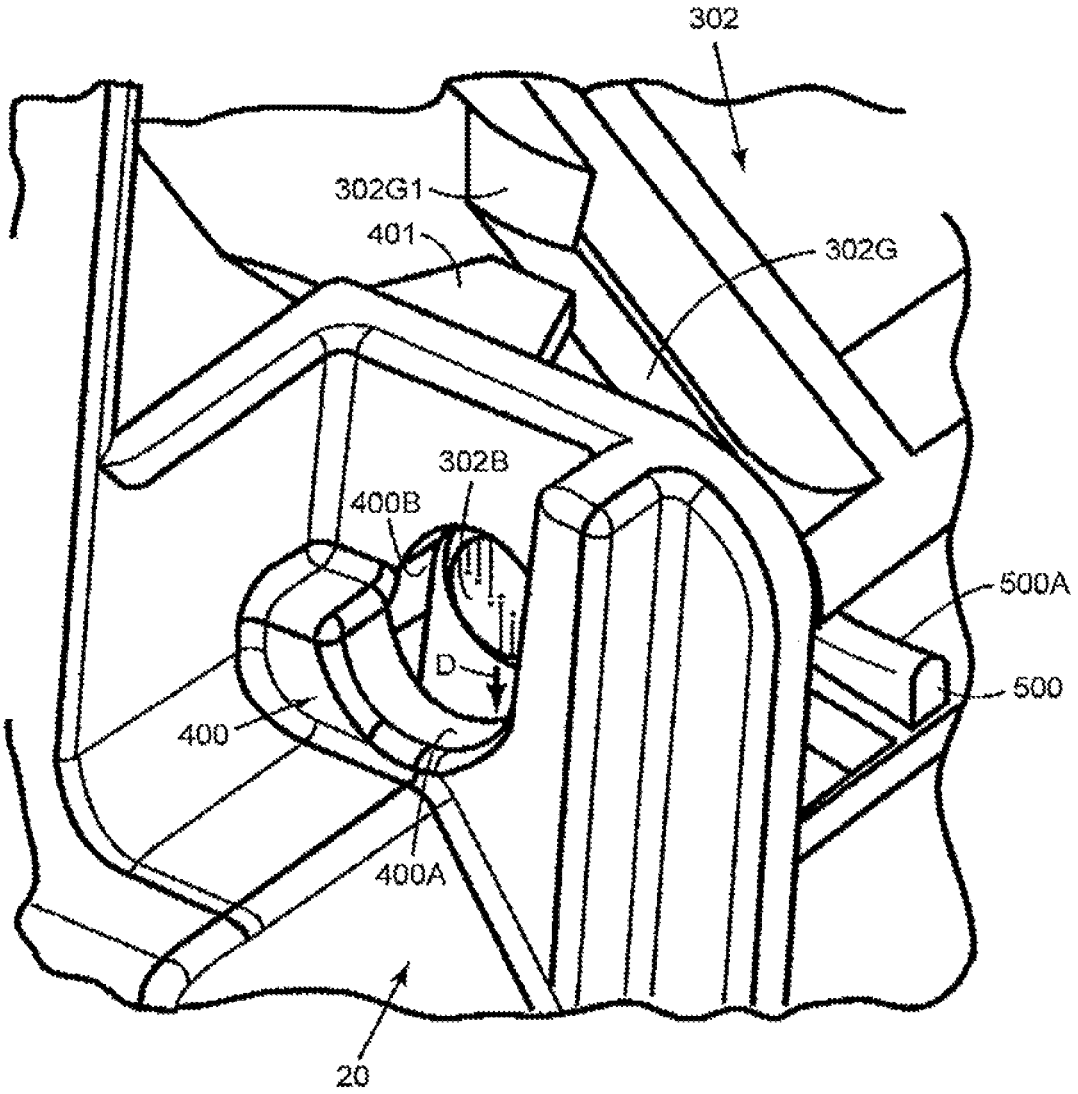
FIG. 8 is a schematic diagram of the bearing part of the conveying guide used in the embodiment of the present invention.

With the configuration described above, when the pivot shaft 302B makes such a positional shift that the head of the pivot shaft 302B is positioned where only the supporting surface 400B for the upper semiperimeter of the pivot shaft 302B is provided as illustrated in FIG. 8, the head of the pivot shaft 302B would separate from the supporting surface 400B as indicated by arrow D. However, a fall of the pivot shaft 302B due to this separation of the pivot shaft 302B is prevented through a support by the separation restricting member 500.

Figure 9A:
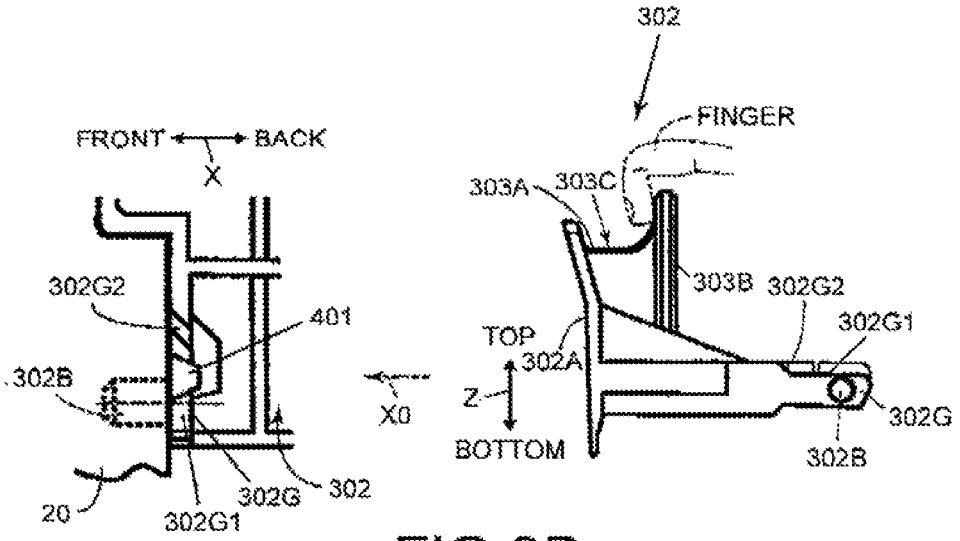
FIGS. 9A, 9B, and 9C are schematic diagrams of states of the conveying guide used in the embodiment of the present invention.

The head of the pivot shaft 302B may be shifted as illustrated in FIG. 8 because of, in addition to dimensional tolerance of the pivot shaft 302B or other components, a forced shift of the pivot shaft 302B in the X direction. Specifically, in order to hold the swingable conveying guide 302 at the first position or the second position described above, a side wall of the swingable conveying guide 302 in the X direction (width direction) is pressed to move the swingable conveying guide 302 in the width direction. With this configuration, the first position is a position at which the conveying path L1 (refer to FIG. 3) illustrated in FIG. 9A is formed, whereas the second position is a position at which the swingable conveying guide 302 is retracted away from the conveying path L1 (refer to FIG. 3) illustrated in FIG. 9C. This configuration adopts the elastic body SP illustrated in FIG. 6C, and a force applied by the elastic body SP presses the swingable conveying guide 302 against a side surface of the housing of the fixing device 20. This side surface is on a side opposite to a side on which the elastic body SP is provided in the X direction. This pressing restricts the swing of the swingable conveying guide 302, holding the swingable conveying guide 302 at the first position or the second position.

Specifically, as illustrated in FIG. 8, an engaging protrusion 401 fixed on the housing of the fixing device 20 is made contact with a side wall 302G of the swingable conveying guide 302 on this opposite side so as to restrict the swing of the swingable conveying guide 302. As illustrated in FIG. 7, the side wall 302G of the swingable conveying guide 302 includes an engaging part 302G1 that is a cut-out part of the side wall 302G, and a tilted surface 302G2 connecting the engaging part and a part of the side wall 302G not cut out. The engaging part 302G1 and the tilted surface 302G2 are formed on both sides of the side wall 302G across the pivot shaft 302B, although not denoted by reference signs in FIG. 7 and FIGS. 9A, 9B, and 9C illustrating the same effect.

Figure 9B:
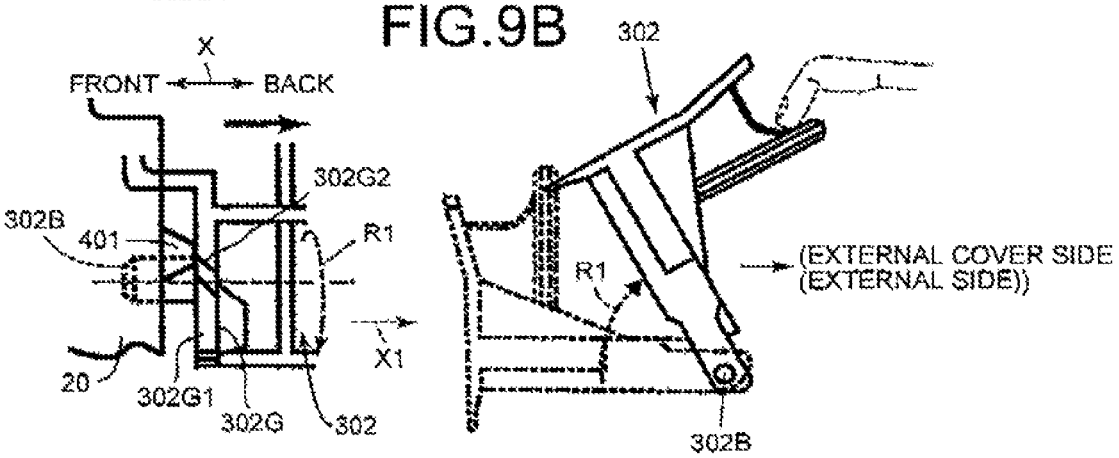
Figure 9C:
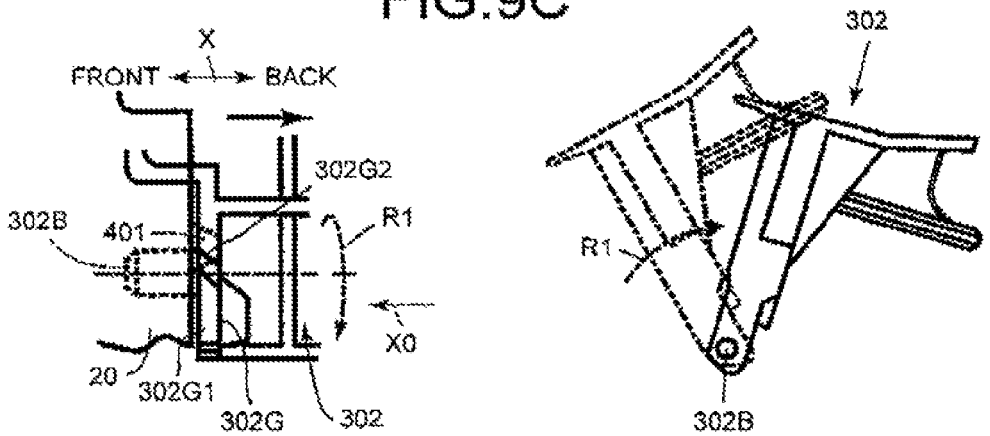

The engaging protrusion 401 is provided at an intermediate position between the first position and the second position of the swingable conveying guide 302, and used as a restricting member that restricts the swing of the swingable conveying guide 302 (hereinafter also referred to as the engaging protrusion 401, for convenience). FIGS. 9A, 9B, and 9C illustrate a facing arrangement among the engaging part 302G1, the tilted surface 302G2, and the engaging protrusion 401 in accordance with the position, in other words, the phase of the swing of the swingable conveying guide 302 about the rotation center CH of the pivot shaft 302B. In FIGS. 9A, 9B, and 9C, the right sides illustrate the phase of the swingable conveying guide 302, whereas the left sides illustrate the facing arrangement in accordance with the phase of the swingable conveying guide 302.

FIG. 9A illustrates that the swingable conveying guide 302 is at the first position, in other words, is closed and forms the conveying path L1 (refer to FIG. 3) of the paper P. In this state, no external force is applied to the elastic body SP, and the swingable conveying guide 302 is positioned on the most front side in the direction X0, and the engaging protrusion 401 is in the engaging part 302G1 in the X direction. This state is maintained through pressing (in the pressing direction indicated by arrow X0) by the elastic body SP. The pressing direction of the elastic body SP indicated by arrow X0 corresponds to the first direction in which the swingable conveying guide 302 is moved in parallel to the pivot shaft 3028 when no external force, in other words, no force in a direction against the pressing force is applied to the elastic body SP. In this case, the swingable conveying guide 302 is positioned at a swing restricted position at which the swing is restricted by the engaging protrusion 401 between the first position and the second position.

FIG. 9B illustrates that the swingable conveying guide 302 is at a halfway position of a swing from the first position to the second position. In this state, the engaging protrusion 401 faces and contacts the tilted surface 302G2 of the side wall 302G. Thus, an external force is applied against the pressing of the elastic body SP, and moves the swingable conveying guide 302 in the direction opposite to the direction X0 as the first direction, as indicated by arrow X1. When moved in the second direction, the swingable conveying guide 302 can be positioned at a swing allowed position, at which the swingable conveying guide 302 is swingable between the first position and the second position.

When the tilted surface 302G2 is pushed by the engaging protrusion 401 in accordance with the tilt thereof, the swingable conveying guide 302 is moved in the second direction, in other words, to the right side in the left diagram of FIG. 9B as indicated by arrow X1, against the force applied by the elastic body SP. Such external force may be applied by hooking the handle part 303 with a finger. Meanwhile, the axial end of the pivot shaft 302B is moved close to the supporting surface 400B as compared to the initial position illustrated in FIG. 9A, and thus the pivot shaft 302B is moved in the direction of arrow D illustrated in FIG. 8, which would result in a fall of the swingable conveying guide 302. However, the swing base end of the swingable conveying guide 302 facing the separation restricting member 500 contacts the separation restricting member 500 before the swingable conveying guide 302 falls, thereby preventing the separation of the swingable conveying guide 302. When the swingable conveying guide 302 has been moved in the direction of arrow X1 until its swing restriction by the engaging protrusion 401 is canceled, the swingable conveying guide 302 is positioned at the swing allowed position, the swingable conveying guide 302 is swingable over the engaging protrusion 401 between the first position and the second position.

FIG. 9C illustrates that the swingable conveying guide 302 has swung in the direction of arrow R1 further from the swing allowed position illustrated in FIG. 9B, and the engaging protrusion 401 has moved over a surface of the side wall 302G of the swingable conveying guide 302 and is in the engaging part therebehind. In this state, similarly to the state illustrated in FIG. 9A, the swingable conveying guide 302 has been moved in the first direction by the elastic body SP and is positioned on the most front side in the direction X0, that is, on the leftmost side in the left diagram of FIG. 9C, and the engaging protrusion 401 is maintained in the engaging part. Accordingly, the swingable conveying guide 302 swings in the second position and is positioned at the swing restricted position at which a swing between the first position and the second position is restricted, and the conveying path L1 (refer to FIG. 3) is maintained open. In this state, the conveying path L1 is open while the swingable conveying guide 302 is moved away from the conveying path L1 (refer to FIG. 3) of the paper P, the paper P causing a paper jam can be removed from the conveying path L1 (refer to FIG. 3).

This open state of the conveying path L1 can be canceled by swinging the swingable conveying guide 302 from the second position to the first position through, for example, an operation of the handle part 303. In this manner, the swingable conveying guide 302 is selectively positioned at the swing restricted position or a swingable position at which a swing is not restricted as described above, depending on an applied state of the external force against the elastic body SP according to a relation between the engaging protrusion 401 and the engaging part 302G1 opposite thereto. When the swingable conveying guide 302 swings from the first position to the second position, and thus an outer surface of the side wall 302G is pushed by the engaging protrusion 401, the axial end of the pivot shaft 302B is moved to the supporting surface 400B depending on, for example, the length of the engaging protrusion 401 and the degree of deflection of the swingable conveying guide 302. In this case, the swingable conveying guide 302 would fall in the direction of arrow D illustrated in FIG. 8, but the swingable conveying guide 302 is supported by the separation restricting member 500, whereby such a fall is prevented. In this manner, the separation restricting member 500 supports the swingable conveying guide 302 in such a manner to prevent the pivot shaft 302B from falling off the bearing part 400.

Providing the separation restricting member 500 can eliminate the need for the supporting surface 400A that supports the lower periphery of the pivot shaft 302B. However, the supporting surface 400A helps, with the corresponding supporting surface 400B, the swingable conveying guide 302 to smoothly swing during positioning of the pivot shaft 302B in the Z direction for the entire periphery of the pivot shaft 302B, and thus such an omission is not recommended. The separation restricting member 500 may serve only to prevent a fall of the pivot shaft 302B off the bearing part 400, and might not serve to position the center of the pivot shaft 302B. For this reason, the supporting surface 400A is preferably provided to define the shaft center of the pivot shaft 302B in the Z direction.

As described above, when positioned at the second position illustrated in FIG. 9C, the swingable conveying guide 302 leaves the conveying path L1 open to allow removal of the paper P causing a paper jam. However, with taken into consideration the visibility for finding out the paper P causing a paper jam and for checking for remaining paper P after removing a paper jam, it is desirable that the swingable conveying guide 302 is swung to a position further in the direction of arrow R1 illustrated in FIG. 9C.

Figure 10:
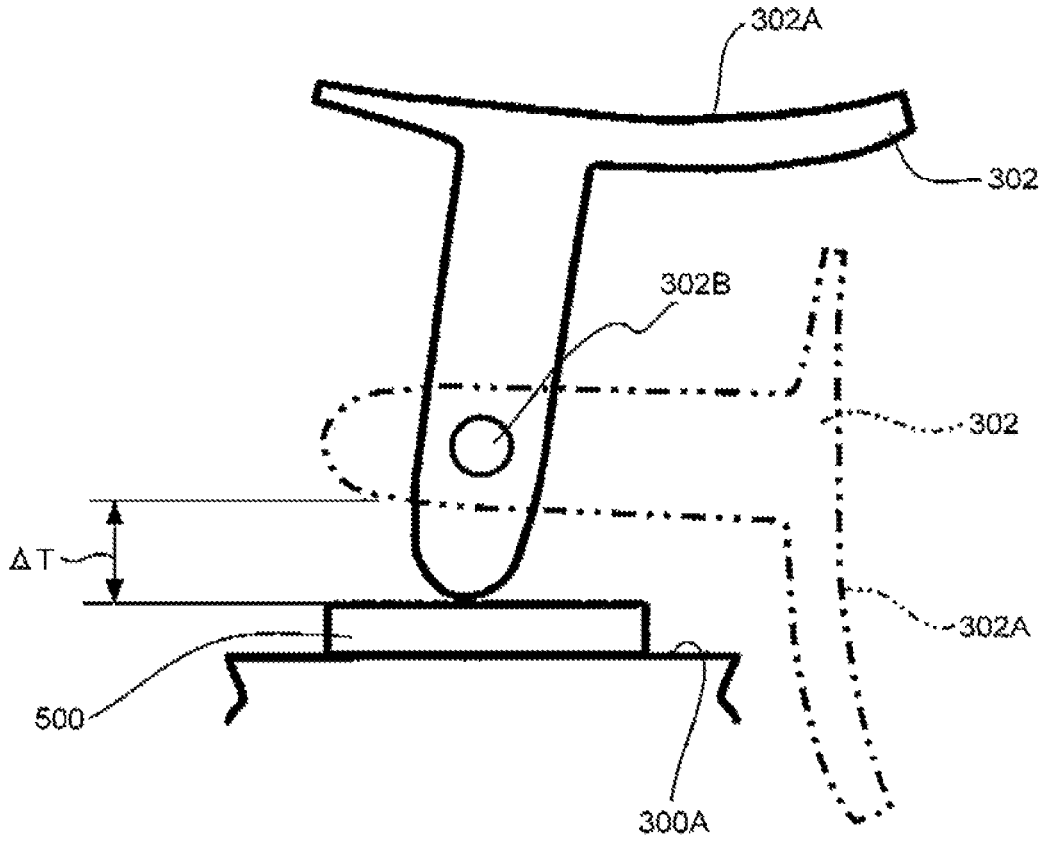
FIG. 10 is a schematic diagram for describing a problem with the conveying guide used in the embodiment of the present invention.

In FIG. 10 illustrating an embodiment of the present invention, when the paper P causing a paper jam is removed, the swingable conveying guide 302 is swung from the second position illustrated with the solid line to a third position illustrated with the dashed and double-dotted line, at which the conveying path L1 is further opened to improve the visibility. The separation restricting member 500 and the swing base end of the swingable conveying guide 302 at the second position facing the separation restricting member 500 are in contact with each other, thereby preventing the swingable conveying guide 302 from falling off the bearing part 400. At the third position, however, the separation restricting member 500 and the swing base end of the swingable conveying guide 302 are not in contact with each other and have a gap ΔT therebetween, and thus the swingable conveying guide 302 may fall off the bearing part 400.

Figure 11:
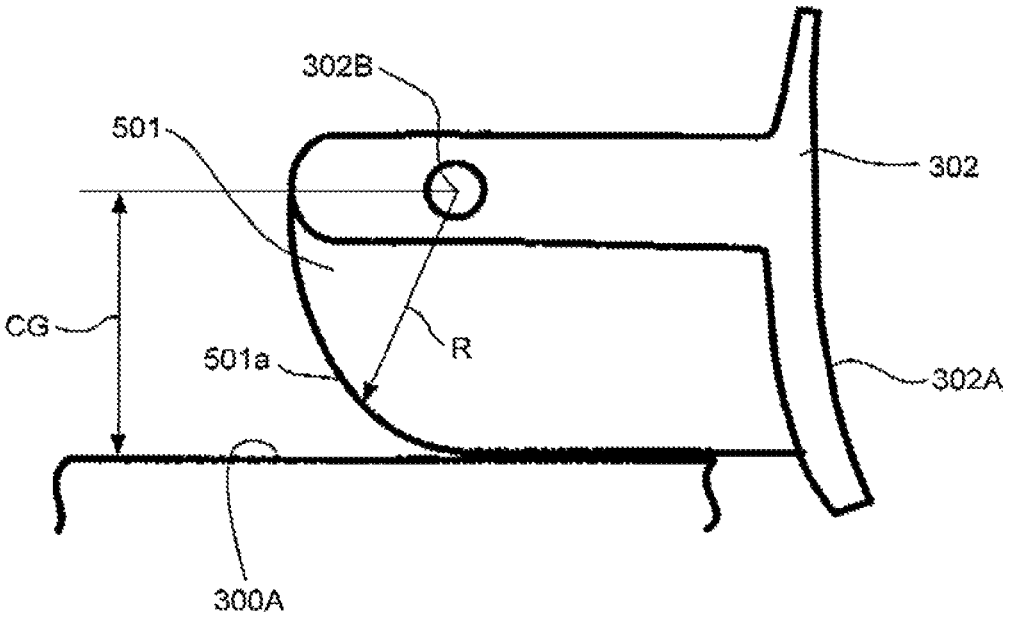
FIG. 11 is a schematic diagram of the conveying guide and a separation restrictor according to the embodiment of the present invention.
Figure 12A:
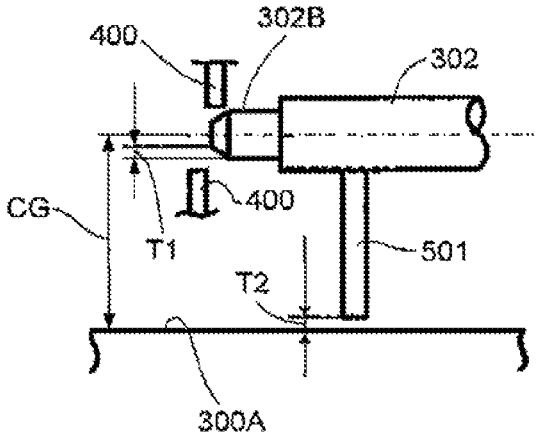
FIGS. 12A and 12B are a schematic diagram of the conveying guide and the separation restrictor according to the embodiment of the present invention.
Figure 12B:
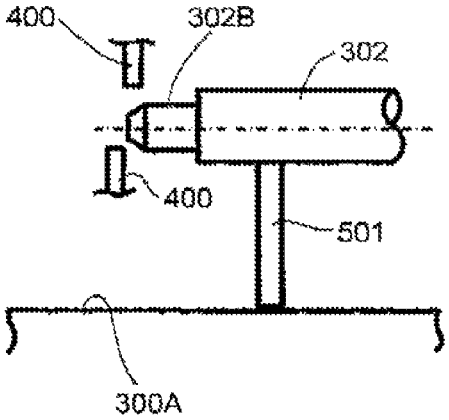

To prevent this fall, in the present embodiment, a separation restrictor 501 as illustrated in FIG. 11 is formed integrally with the swingable conveying guide 302 at a position in the axial direction of the pivot shaft 302B (the X direction), at which the separation restricting member 500 is not provided. The separation restrictor 501 includes an arc part 501*a* having an arc shape of a radius R smaller than a distance CG from the swing center of the swingable conveying guide 302 to the conveying-guide facing surface 300A. When the pivot shaft 302B is supported by the bearing part 400, a constant clearance is maintained between the separation restrictor 501 and the conveying-guide facing surface 300A, preventing an operation failure and a component breakage during the swing of the swingable conveying guide 302.

With this configuration, the separation restrictor 501 contacts the conveying-guide facing surface 300A when the swingable conveying guide 302 is swung by an angle beyond an obtuse angle from the first position as the initial position to the third position illustrated in FIG. 11 and consequently the pivot shaft 302B separates from the bearing part 400. Thus, the fall of the swingable conveying guide 302 can be reliably prevented when the swingable conveying guide 302 is swung by any angle.

In the configuration described above, the radius R of the separation restrictor 501 is desirably set to a value obtained by subtracting, from the distance CG, a value T2 not larger than the height T1 of C-shaped chamfering provided at the head of the pivot shaft 302B. With this arrangement, a fall of the swingable conveying guide 302 when the pivot shaft 302B is shifted from the supporting surface 400A of the bearing part 400 can be prevented through the contact between the separation restrictor 501 and the conveying-guide facing surface 300A. In addition, the force applied by the elastic body SP and the chamfered shape of the head of the pivot shaft 302B help move the pivot shaft 302B back to the supporting surface 400A, thereby further preventing the separation of the pivot shaft 302B from the bearing part 400.

Figure 14:
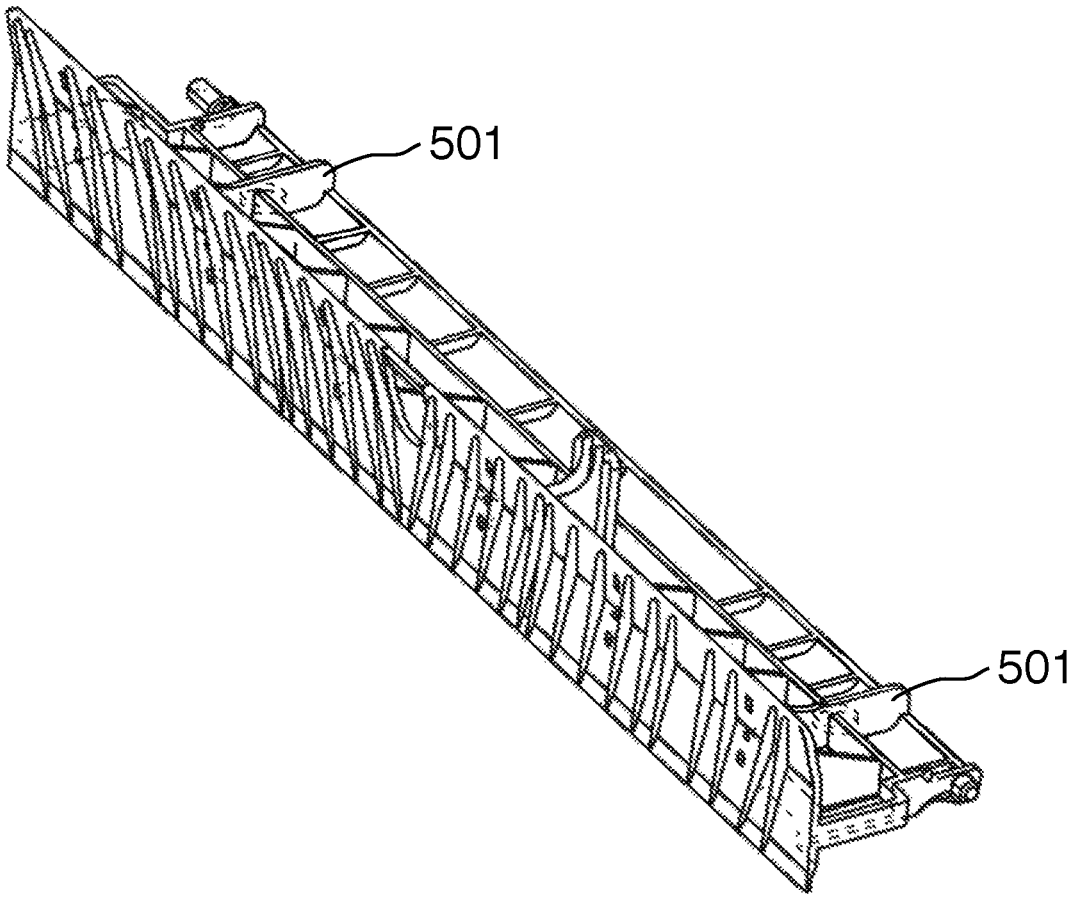
FIG. 14 illustrates a plurality of separation restrictors provided in an axial direction of the pivot shaft.

In the embodiment described above, arranging a plurality of separation restrictors 501 in the axial direction of the pivot shaft 302B (the X direction) can prevent any stress concentration on the single separation restrictor 501, thereby preventing breakage of the separation restrictor 501. See FIG. 14.

Figure 13:
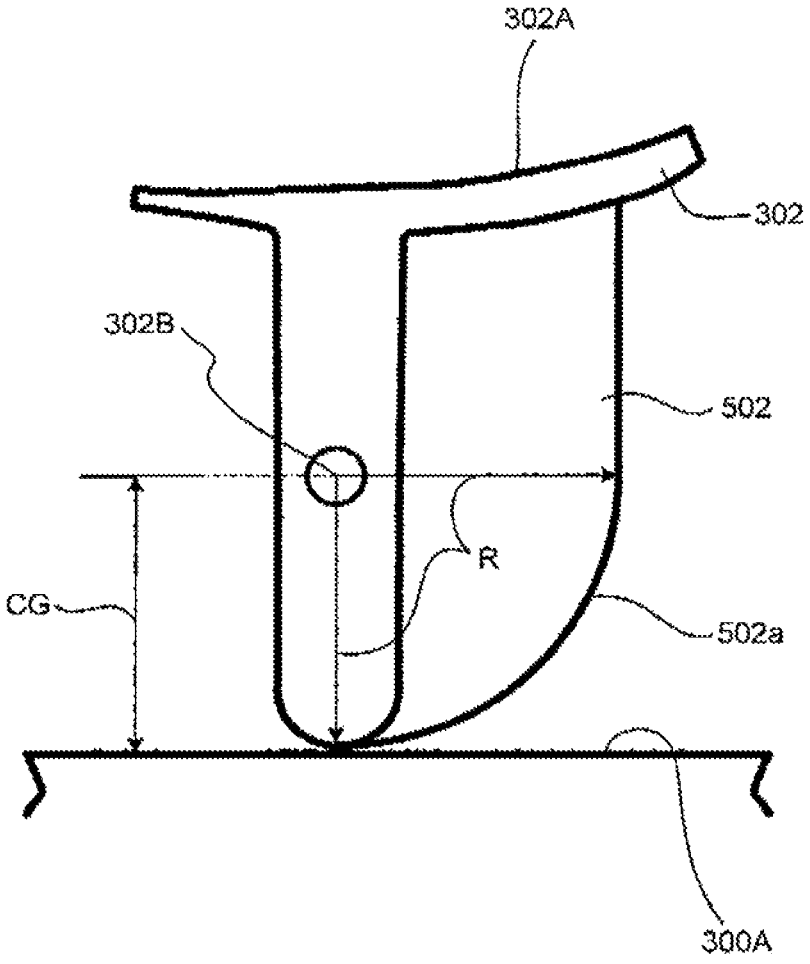
FIG. 13 is a schematic diagram of a conveying guide and a separation restrictor according to a modification of the embodiment of the present invention.

As a modification of the embodiment, a separation restrictor 502 may be formed integrally with the swingable conveying guide 302 in place of the separation restrictor 501 as illustrated in FIG. 13. The separation restrictor 502 is formed to have a length slightly shorter than the distance CG at which the separation restrictor 502 is in contact with the conveying-guide facing surface 300A when the swingable conveying guide 302 is positioned at the second position. The separation restrictor 502 has an arc shape 502*a* of a radius of this length. This configuration has the same effect as that of the embodiment and allows omission of the separation restricting member 500, thereby achieving simplification and cost reduction of the device.

While the present invention has been described with reference to the preferred embodiment, it is to be understood that the present invention is not limited to the disclosed embodiment. Various modifications and changes are possible within the scope of the present invention disclosed in the following claims unless specified otherwise in the description. For example, the conveying guide may be a fixing entrance guide provided on the exit side of the fixing device end having the conveyance surface on the entrance side of the nipping part. That is, the conveying guide only needs to have the conveyance surface provided next to the nipping part of the fixing device. In addition, the paper conveying device may be configured to convey a recording medium at a position far from the fixing device in the image forming device. The effect described in the embodiment of the present invention only includes the most preferred effects obtainable by the present invention, and the effects obtainable by the present invention are not limited to the description of the embodiment of the present invention.

According to the present invention, the separation restrictor contacts the conveying-guide facing surface when the pivot shaft separates from the bearing part, and thus the fall of the conveying guide can be reliably prevented when the conveying guide is swung by any angle.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper conveying device, comprising:

a conveying guide that includes a conveyance surface for conveying paper and a pivot shaft, the conveying guide being swingable about the pivot shaft;

a bearing that includes a support surface facing at least an upper semiperimeter of the pivot shaft;

a conveying-guide facing surface that is provided to face an end of the conveying guide when the conveying guide swings, the end of the conveying guide being opposite to the conveyance surface; and a separation restrictor that is provided on the conveying guide to restrict separation of the pivot shaft from the bearing at least in a given swing range of the conveying guide by maintaining contact with the conveying-guide facing surface as the conveying guide moves through the given swing range.

2. The paper conveying device according to claim 1, wherein the separation restrictor is shaped in an arc having a radius smaller than a distance between a center of the pivot shaft and the conveying-guide facing surface.

3. The paper conveying device according to claim 2, wherein the pivot shaft has a chamfered head peripheral part, and the radius has a value obtained by subtracting a value not larger than a height of the chamfering from the distance between the center of the pivot shaft and the conveying-guide facing surface.

4. The paper conveying device according to claim 1, wherein the separation restrictor includes a plurality of separation restrictors provided in an axial direction of the pivot shaft.

5. The paper conveying device according to claim 1, further comprising a separation restricting member arranged on the conveying-guide facing surface to restrict the separation of the pivot shaft from the bearing by contacting the end of the conveying guide.

6. A paper conveying device, comprising:

a conveying guide that includes a conveyance surface for conveying paper and a pivot shaft, the conveying guide being swingable about the pivot shaft;

a bearing that includes a support surface facing at least an upper semiperimeter of the pivot shaft;

a conveying-guide facing surface that is provided to face an end of the conveying guide when the conveying guide swings, the end of the conveying guide being opposite to the conveyance surface; and a separation restricting member arranged on the conveying-guide facing surface to restrict the separation of the pivot shaft from the bearing by contacting the end of the conveying guide.

7. A paper conveying device, comprising:

a conveying guide that includes a conveyance surface for conveying paper and a pivot shaft, the conveying guide being swingable about the pivot shaft;

a bearing that includes a support surface facing at least an upper semiperimeter of the pivot shaft;

a conveying-guide facing surface that is provided to face an end of the conveying guide when the conveying guide swings, the end of the conveying guide being opposite to the conveyance surface; and a separation restrictor that is provided on the conveying guide to restrict separation of the pivot shaft from the bearing at least in a given swing range of the conveying guide by contacting the conveying-guide facing surface, wherein the separation restrictor is shaped in an arc having a radius smaller than a distance between a center of the pivot shaft and the conveying-guide facing surface.

8. The paper conveying device of claim 5, wherein the separation restrictor is provided on the conveying guide at a position in an axial direction of the pivot shaft at which the separation restricting member is not provided.

9. A paper conveying device, comprising:

a conveying guide that includes a conveyance surface for conveying paper and a pivot shaft, the conveying guide being swingable about the pivot shaft;

a bearing that includes a support surface facing at least an upper semiperimeter of the pivot shaft;

a conveying-guide facing surface that is provided to face an end of the conveying guide when the conveying guide swings, the end of the conveying guide being opposite to the conveyance surface; and a separation restrictor that is provided on the conveying guide to restrict separation of the pivot shaft from the bearing at least in a given swing range of the conveying guide by contacting the conveying-guide facing surface, wherein the separation restrictor is shaped in an arc having a radius smaller than a distance between a center of the pivot shaft and the conveying-guide facing surface.

10. The paper conveying device of claim 9, wherein the pivot shaft has a chamfered head peripheral part, and the radius has a value obtained by subtracting a value not larger than a height of the chamfering from the distance between the center of the pivot shaft and the conveying-guide facing surface.

11. The paper conveying device of claim 9, wherein the separation restrictor includes a plurality of separation restrictors provided in an axial direction of the pivot shaft.

12. The paper conveying device of claim 9, further comprising a separation restricting member arranged on the conveying-guide facing surface to restrict the separation of the pivot shaft from the bearing by contacting the conveying guide.

* * * * *